US006632149B2

(12) United States Patent
Yoshida

(10) Patent No.: US 6,632,149 B2
(45) **Date of Patent: *Oct. 14, 2003**

(54) MULTI-PIECE SOLID GOLF BALL

(75) Inventor: Kazunari Yoshida, Kobe (JP)

(73) Assignee: Sumitomo Rubber Industries, Ltd., Hyogo-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/801,782

(22) Filed: Mar. 9, 2001

(65) Prior Publication Data

US 2001/0044346 A1 Nov. 22, 2001

(30) Foreign Application Priority Data

Mar. 9, 2000 (JP) ..... 2000-064828

(51) Int. Cl.[7] ..... A63B 37/04; A63B 37/06; A63B 37/00

(52) U.S. Cl. ..... 473/377; 473/371; 473/351

(58) Field of Search ..... 473/351–377

(56) References Cited

U.S. PATENT DOCUMENTS 5,556,098 A 9/1996 Higuchi et al.
5,704,854 A 1/1998 Higuchi et al.
5,830,085 A * 11/1998 Higuchi et al. ..... 473/373
6,004,226 A * 12/1999 Asakura ..... 273/DIG. 10
6,045,459 A * 4/2000 Sugimoto et al. ..... 473/354
6,120,391 A * 9/2000 Moriyama et al. ..... 473/374
6,190,269 B1 * 2/2001 Moriyama ..... 473/373
6,315,682 B1 * 11/2001 Iwami et al. ..... 473/370
6,336,872 B1 * 1/2002 Moriyama et al. ..... 473/374

* cited by examiner

*Primary Examiner*—Paul T. Sewell
*Assistant Examiner*—Alvin A. Hunter, Jr.
(74) *Attorney, Agent, or Firm*—Birch, Stewart, Kolasch & Birch, LLP

(57) ABSTRACT

The invention provides a multi-piece solid golf ball having improved flight performance, controllability and good shot feel at the time of hitting. The multi-piece solid gold ball has a core having at least one layer, an intermediate layer formed on the core, and a cover covering the intermediate layer. When thickness of the intermediate layer is represented as X (mm) and JIS-C hardness of the intermediate layer is represented as Y, then X is 0.3 to 1.5 mm, X and Y have a correlation represented $10X+55 \leqq Y \leqq 10X+75$, and the JIS-C hardness of the cover is 70 to 93.

12 Claims, 6 Drawing Sheets

MULTI-PIECE SOLID GOLF BALL

FIELD OF THE INVENTION

The present invention relates to a multi-piece solid golf ball. More particularly, it relates to a multi-piece solid golf ball having excellent flight performance by accomplishing high launch angle and low spin amount, and having good shot feel, which is light and has good rebound, when hit by using from a driver and long iron club to a middle iron club. In addition, the multi-piece solid golf ball has excellent controllability by accomplishing high spin at short iron shots to approach shots, and having very soft and good shot feel at short iron shots to approach shots and putts.

BACKGROUND OF THE INVENTION

Solid golf balls, which have good rebound characteristics and small spin amount, are generally approved of or employed by most general amateur golfers, who regard flight distance as the most important characteristic of a golf ball. On the other hand, professional golfers and high level golfers regard controllability as most important, followed by soft and good shot feel, and flight performance. Therefore they have mainly employed thread wound golf balls, because they regard controllability as most important and the golf ball has soft and good shot feel.

The thread wound golf ball has sufficiently satisfied performance in view of controllability when hit by a short iron club and the like and has soft and good shot feel. However, it is a problem that the thread wound golf ball has a structure, which is easy to apply spin, and it has a high spin amount when hit not only by a short iron club, where the controllability is required, but by a driver to middle iron club, which reduces the flight performance, and the shot is heavy and poor.

In order to solve the problem, many two-piece and three-piece solid golf balls, of which the shot feel and flight performance are improved while maintaining good controllability, have been proposed (Japanese Patent Kokai Publication Nos. 239067/1997, 332247/1996, 313643/1997, 10358/1997, and Japanese Patent No. 2658811 and the like), and they generally occupy the greater part of the golf ball market.

In Japanese Patent Kokai Publication No. 239067/1997, a two-piece solid golf ball which comprises a core and a cover is described. The core has a surface hardness in JIS-C hardness of not more than 85, a center hardness in JIS-C hardness is lower than the surface hardness by not more than 8 and less than 20, a hardness at the distance of not more than 5 mm from the surface of the core is lower than the surface hardness by not more than 8, a hardness of the cover is higher than the surface hardness of the core by 1 to 15, a thickness of the cover is 1.5 to 1.95 mm, and a number of dimples is within the range of 360 to 450.

In Japanese Patent Kokai Publications Nos. 332247/1996 and 313643/1997, a three-piece solid golf ball which comprises a two-layer structured core and a cover is described. In Japanese Patent Kokai Publications No. 332247/1996, a three-piece solid golf ball which comprises a two-layer structured core composed of an inner core and outer core, and a cover is described. The inner core has a diameter of 25 to 37 mm, has a center hardness in JIS-C hardness of 60 to 85 and has a hardness difference from the center of the inner core to the surface of the inner core is within the range of not more than 4, the outer core has a surface hardness in JIS-C hardness of 75 to 90, and the cover has a flexural modulus of 1,200 to 3,600 kg/cm$^2$.

In Japanese Patent Kokai Publications No. 313643/1997, a three-piece solid golf ball of which an intermediate layer is placed between a core and a cover is described. The core has a center hardness in JIS-C hardness of not more than 75 and has a surface hardness in JIS-C hardness of not more than 85, the surface hardness is higher than the center hardness by 5 to 25, a hardness of the intermediate layer is higher than the surface hardness of the core by less than 10, and a hardness of the cover is higher than the hardness of the intermediate layer.

In Japanese Patent No. 2658811 and Japanese Patent Kokai Publications No. 10358/1997, a three-piece solid golf ball which comprises a core and a two-layer structured cover is described. In Japanese Patent No. 2658811, a three-piece solid golf ball of which an intermediate layer is placed between a center core and a cover is described. The center core has a diameter of not less than 26 mm, a specific gravity of less than 1.4 and a JIS-C hardness of not more than 80, the intermediate layer has a thickness of not less than 1 mm, a specific gravity of less than 1.2 and a JIS-C hardness of less than 80, and the cover has a thickness of 1 to 3 mm and a JIS-C hardness of not less than 85.

In Japanese Patent Kokai Publications No. 10358/1997, a three-piece solid golf ball of which an intermediate layer is placed between a center core and a cover is described. The intermediate layer has a Shore D hardness of 30 to 55, and the cover has a Shore D hardness of 45 to 58.

In the golf balls described above, flight performance and shot feel when hit by using from a driver to a middle iron club are improved, but sufficient performances has not been obtained in view of the balance of the flight performance and shot feel, and controllability at short iron shot to approach shot. If the controllability will be improved, spin amount is large when hit by using from a long iron club to a middle iron club, where long flight distance is still required, and the flight distance is reduced. If the flight distance when hit by using from a driver to a middle iron club will be improved, shot feel at short iron shot to approach shot and put is hard or heavy, and poor. Therefore, a golf ball having sufficient performances has been obtained.

OBJECTS OF THE INVENTION

A main object of the present invention is to provide a multi-piece solid golf ball, of which flight performance, controllability and good shot feel at the time of hitting are improved.

According to the present invention, the object described above has been accomplished by providing a multi-piece solid golf ball comprising a core having at least one layer, an intermediate layer and a cover, and adjusting a thickness and hardness of the intermediate layer and a hardness of the cover to specified ranges, thereby providing a multi-piece solid golf ball, of which flight performance, controllability and good shot feel at the time of hitting are improved.

This object as well as other objects and advantages of the present invention will become apparent to those skilled in the art from the following description with reference to the accompanying drawings.

BRIEF EXPLANATION OF DRAWINGS

The present invention will become more fully understood from the detailed description given hereinbelow and the accompanying drawings which are given by way of illustrating only, and thus are not limiting the present invention, and wherein.

SUMMARY OF THE INVENTION

Figure 1:
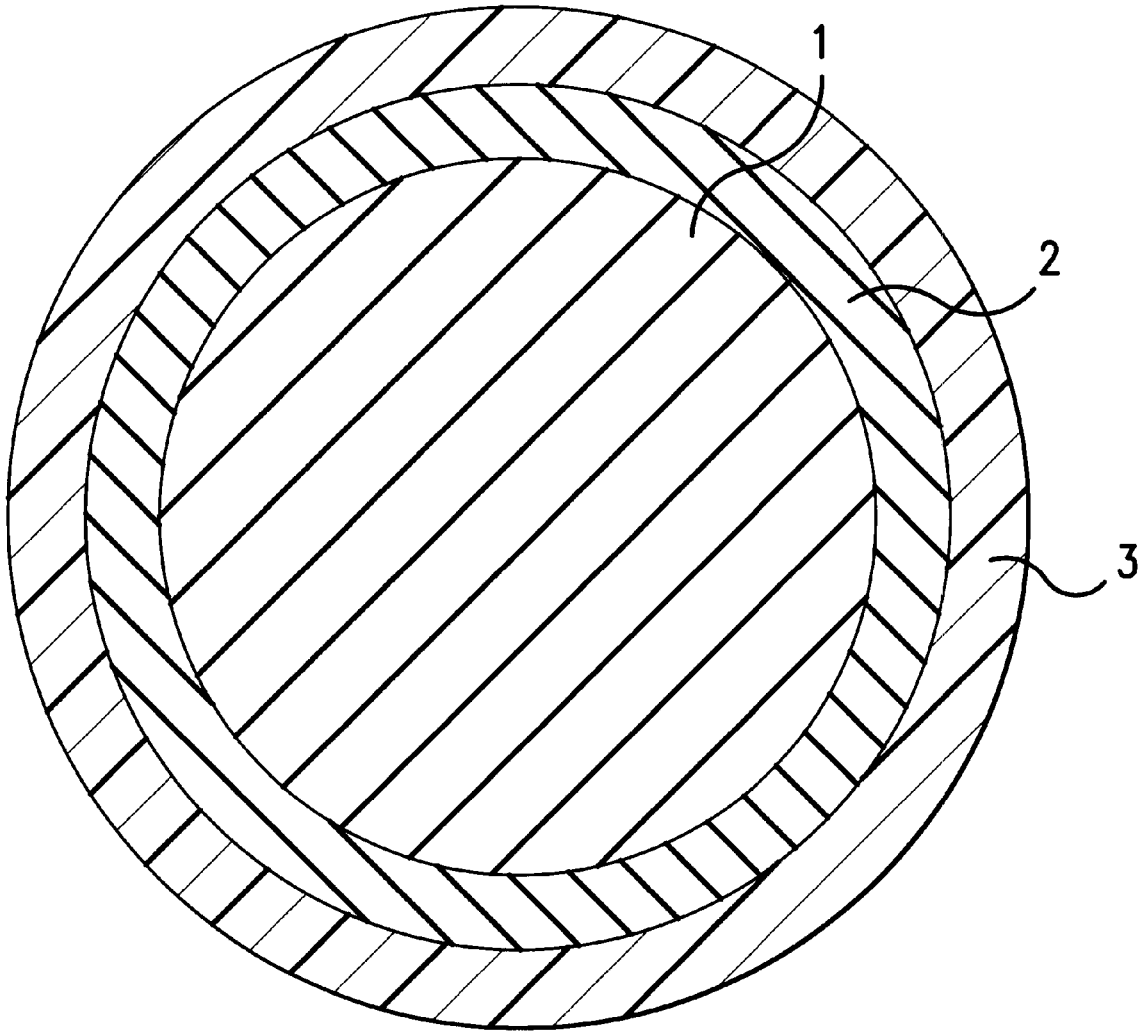
FIG. 1 is a schematic cross section illustrating one embodiment of the golf ball of the present invention.

The present invention provides a multi-piece solid golf ball comprising a core having at least one layer, an intermediate layer formed on the core, and a cover covering the intermediate layer, wherein assuming that a thickness of the intermediate layer is represented as X (mm) and a hardness in JIS-C hardness of the intermediate layer is represented as Y, X is within the range of 0.3 to 1.5 mm, X and Y have a correlation represented by the following formula:

$$10X+55 \leqq Y \leqq 10X+75,$$

and a hardness in JIS-C hardness of the cover (C) is within the range of 70 to 93.

Since the golf ball of the present invention has the structure described above, very large energy is applied to the golf ball when hit by using from a driver to a middle iron club at relatively high head speed. Therefore, the golf ball, which does not deform partially at the surface, largely deforms in whole, and the golf ball has excellent flight performance by accomplishing high launch angle and low spin amount. In addition, since the golf ball deforms in whole, the effect of the core on the deformation of the golf ball is larger than the effect of the intermediate layer, which is thin and soft, thereon, and the golf ball has good shot feel, which is light and has good rebound.

On the other hand, since small energy is applied to the golf ball at short iron shot to approach shot or putt at relatively low head speed, partial deformation at the surface of the golf ball is larger than deformation of the golf ball in whole. Therefore a contact area with the face of a golf club at the time of hitting is large, and the spin amount is large, which improves the controllability. In addition, the technical effect accomplished by a soft intermediate layer can be sufficiently obtained, and the golf ball has soft and good shot feel, and excellent controllability (the golf ball is put on the club face at the time of hitting).

In a loft angle of the golf club, typically, that of a driver, which is approximately 10 degrees, is small, but that of a short iron club, which is approximately 55 degrees, is large. Therefore effect of the intermediate layer, which is relatively thin and soft, on the deformation of the golf ball when hit by a driver is small, but the effect when hit by a short iron club is large for its thickness, because force is applied to the golf ball in diagonal direction against the intermediate layer when hit by a short iron club.

If the cover having relatively high hardness is used, sufficient spin amount can be obtained by the effect of the present invention on the deformation of the golf ball, and the rebound characteristics are improved. It is advantage for the rebound characteristics that sufficient spin amount can be obtained by using the cover having higher hardness, because generally the rebound characteristics are suddenly degraded when the cover hardness is low.

In order to put the present invention into a more suitable practical application, it is desired that a difference (B-A) between the surface hardness of the core (B) and a center hardness in JIS-C hardness of the core (A) is within the range of 15 to 40; the hardness Y of the intermediate layer is lower than the surface hardness of the core B, and is lower than the hardness of the cover (C).

DETAILED DESCRIPTION OF THE INVENTION

The multi-piece solid golf ball of the present invention will be explained with reference to the accompanying drawing in detail. FIG. 1 is a schematic cross section illustrating one embodiment of the multi-piece solid golf ball of the present invention. As shown in FIG. 1, the golf ball of the present invention comprises a core 1 having single-layer structure or multi-layer structure, an intermediate layer 2 formed on the core 1, and a cover 3 covering the intermediate layer. In order to explain the golf ball of the present invention simply, a golf ball having single-layer structured core 1, i.e. three-piece solid golf ball, will be used hereinafter for explanation. However, the golf ball of the present invention may be applied for the golf ball having two or more layers of core.

Both the core 1 and the intermediate layer 2 are obtained by press-molding a rubber composition under applied heat. The rubber composition essentially contains polybutadiene, a co-crosslinking agent, an organic peroxide and a filler. The polybutadiene used in the present invention may be one, which has been conventionally used for cores of solid golf balls. Preferred is so-called high-cis polybutadiene rubber containing a cis-1, 4 bond of not less than 40%, preferably not less than 80%. The high-cis polybutadiene rubber may be optionally mixed with natural rubber, polyisoprene rubber, styrene-butadiene rubber, ethylene-propylene-diene rubber (EPDM) and the like.

The co-crosslinking agent can be a metal salt of α, β-unsaturated carboxylic acid, including mono or divalent metal salts, such as zinc or magnesium salts of α, β-unsaturated carboxylic acids having 3 to 8 carbon atoms (e.g. acrylic acid, methacrylic acid, etc.), or a blend of the metal salt of α, β-unsaturated carboxylic acid and acrylic ester or methacrylic ester and the like. The preferred co-crosslinking agent for the core 1 is zinc acrylate because it imparts high rebound characteristics to the resulting golf ball, and the preferred co-crosslinking agent for the intermediate layer 2 is magnesium methacrylate because it imparts good releasability from a mold to the intermediate layer. The amount of the co-crosslinking agent is from 5 to 70 parts by weight, preferably from 10 to 50 parts by weight, based on 100 parts by weight of the polybutadiene. When the amount of the co-crosslinking agent is larger than 70 parts by weight, the resulting golf ball is too hard, and the shot feel is poor. On the other hand, when the amount of the co-crosslinking agent is smaller than 5 parts by weight, it is required to increase an amount of the organic peroxide in order to impart a desired hardness to the resulting golf ball. Therefore, the rebound characteristics are degraded.

The organic peroxide includes, for example, dicumyl peroxide, 1,1-bis (t-butylperoxy)-3,3,5-trimethylcyclohexane, 2,5-dimethyl-2,5-di(t-butylperoxy) hexane, di-t-butyl peroxide and the like. The preferred organic peroxide is dicumyl peroxide. The amount of the organic peroxide is from 0.2 to 7.0 parts by weight, preferably 0.5 to 5.0 parts by weight, based on 100 parts by weight of the polybutadiene. When the amount of the organic peroxide is smaller than 0.2 parts by weight, the resulting golf ball is too soft, and the rebound characteristics are degraded, which reduces the flight distance. On the other hand, when the amount of the organic peroxide is larger than 7.0 parts by weight, it is required to decrease an amount of the co-crosslinking agent in order to impart a desired hardness to the resulting golf ball. Therefore, the rebound characteristics are degraded, which reduces the flight distance.

The filler, which can be typically used for the core of solid golf ball, includes for example, inorganic filler (such as zinc oxide, barium sulfate, calcium carbonate, magnesium oxide and the like), high specific gravity metal powder filler (such as tungsten powder, molybdenum powder and the like), and the mixture thereof. The amount of the filler is from 3 to 50 parts by weight, preferably from 10 to 30 parts by weight, based on 100 parts by weight of the polybutadiene. When the amount of the filler is smaller than 3 parts by weight, it is difficult to adjust the weight of the resulting golf ball. On the other hand, when the amount of the filler is larger than 50 parts by weight, the weight ratio of the rubber component in the core is small, and the rebound characteristics reduce too much.

The rubber compositions for the core and intermediate layer of the golf ball of the present invention can contain other components, which have been conventionally used for preparing the core of solid golf balls, such as antioxidant or peptizing agent. If used, the amount of the antioxidant is preferably 0.1 to 1.0 parts by weight, and that of the peptizing agent is preferably 0.1 to 5.0 parts by weight, based on 100 parts by weight of the polybutadiene.

Figure 2:
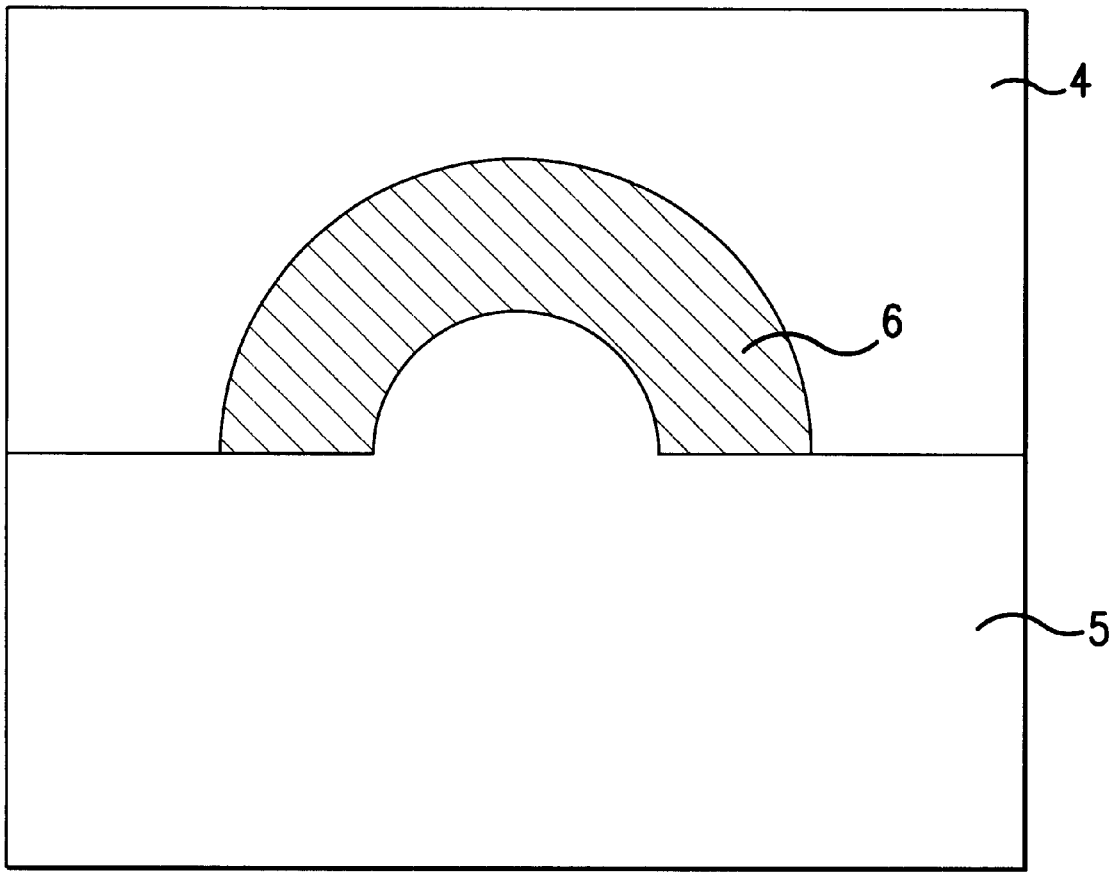
FIG. 2 is a schematic cross section illustrating one embodiment of a mold for molding a vulcanized semi-spherical half-shell for the intermediate layer of the golf ball of the present invention.
Figure 3A:
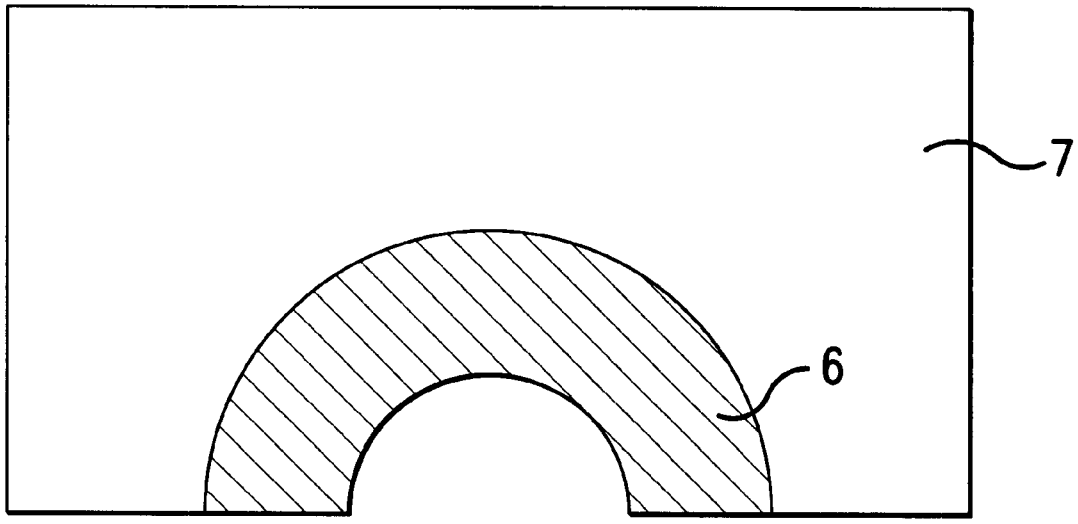
FIG. 3 is a schematic cross section illustrating one embodiment of a mold for molding a two-layer structured core of the golf ball of the present invention.
Figure 3B:
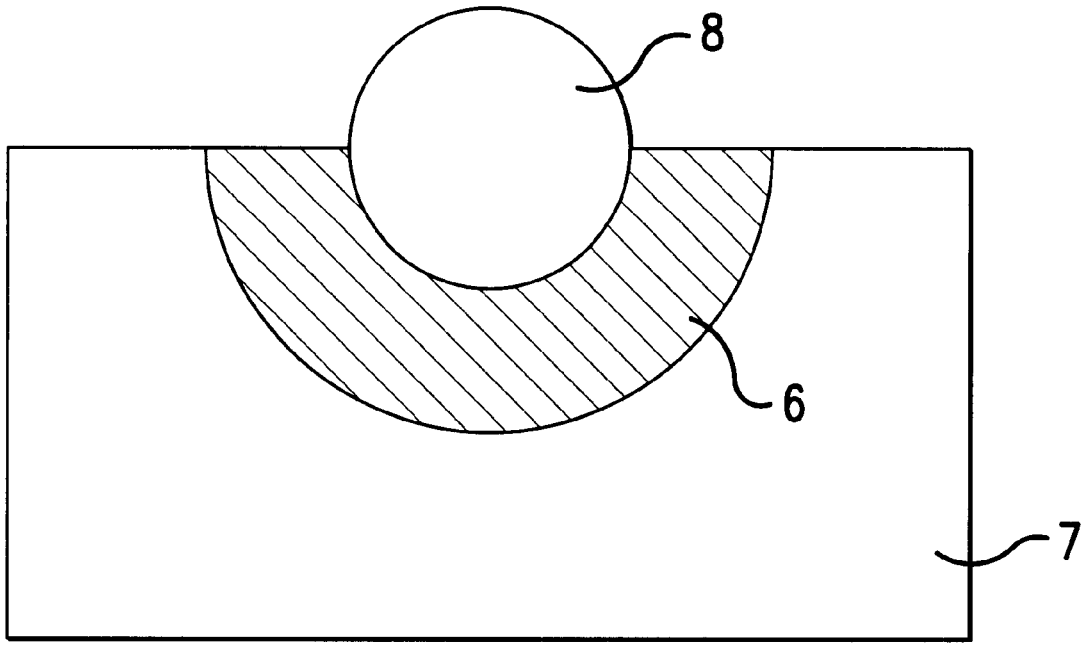

The process of producing the two-layer structured core of the golf ball of the present invention will be explained with reference to FIG. 2 and FIG. 3. FIG. 2 is a schematic cross section illustrating one embodiment of a mold for molding an intermediate layer of the golf ball of the present invention. FIG. 3 is a schematic cross section illustrating one embodiment of a mold for molding a two-layer structured core of the golf ball of the present invention. The rubber composition for the core is molded by using an extruder to form a cylindrical unvulcanized core. The rubber composition for the intermediate layer is then vulcanized by press-molding under applied heat, for example, at 120 to 160° C. for 2 to 30 minutes using a mold having a semi-spherical cavity 4 and a male plug mold 5 having a semi-spherical convex having the same shape as the core as described in FIG. 2 to obtain a vulcanized semi-spherical half-shell 6 for the intermediate layer. The unvulcanized core 8 is covered with the two vulcanized semi-spherical half-shells 6 for the intermediate layer, and then vulcanized by integrally press-molding, for example, at 140 to 180° C. for 10 to 60 minutes in a mold 7 for molding a core, which is composed of an upper mold and a lower mold, as described in FIG. 3 to obtain the two-layer structured core. The two-layer structured core is composed of the core 1 and the intermediate layer 2 formed on the core. In the process of producing the two-layer structured core of the present invention, the mold contacts with only the intermediate layer during the molding. Therefore the productivity is good by using magnesium methacrylate as a co-crosslinking agent in the rubber composition for the intermediate layer, because it imparts good releasability from a mold to the core.

In the golf ball of the present invention, the core 1 has a diameter of 34.5 to 40.5 mm, preferably 35.5 to 39.5 mm. When the diameter of the core is smaller than 34.5 mm, it is required to increase the thickness of the intermediate layer or the cover to a thickness more than a desired thickness. Therefore, the rebound characteristics are degraded, or the shot feel is hard and poor. On the other hand, when the diameter of the core is larger than 40.5 mm, it is required to decrease the thickness of the intermediate layer or the cover to a thickness less than a desired thickness. Therefore the technical effects accomplished by the presence of the intermediate layer are not sufficiently obtained.

In the golf ball of the present invention, it is desired that a difference (B-A) between a surface hardness in JIS-C hardness of the core (B) and a center hardness in JIS-C hardness of the core (A) is within the range of 15 to 40, preferably 17 to 35, more preferably 20 to 30. When the hardness difference is smaller than 15, the golf ball does not deform in whole when hit at high head speed, and the spin amount is large, which reduces the flight distance. In addition, the shot feel is hard and poor. On the other hand, when the hardness difference is larger than 40, the rebound characteristics are degraded, which reduces the flight distance. In addition, the shot feel is heavy and poor.

In the golf ball of the present invention, it is desired for the core 1 to have a center hardness in JIS-C hardness (A) of 50 to 70, preferably 53 to 66, more preferably 56 to 62. When the hardness is smaller than 50, the shot feel is heavy and poor, and the core is too soft, and the rebound characteristics are degraded, which reduces the flight distance. On the other hand, when the hardness is larger than 70, the shot feel is hard and poor. In addition, the rebound characteristics are sufficiently obtained, but the launch angle is small, which reduces the flight distance.

In the golf ball of the present invention, it is desired for the core 1 to have a surface hardness in JIS-C hardness (B) of 70 to 95, preferably 85 to 90. When the hardness is smaller than 70, the core is too soft, and the rebound characteristics are degraded and the technical effects accomplished by the deformation of the intermediate layer described above are not sufficiently obtained, which reduces the flight distance. On the other hand, when the hardness is larger than 95, the core is too hard, and the shot feel is hard and poor.

A center hardness of the core as used herein means a hardness determined by cutting the two-layer structured core, which is formed by integrally press-molding the core and the intermediate layer, into two equal, and then measuring a hardness at the center point of the core in section. A surface hardness of the core means a hardness determined by removing the intermediate layer from the two-layer structured core to expose the core after molding, and measuring a hardness at the surface of the exposed core.

In the golf ball of the present invention, assuming that a thickness of the intermediate layer 2 is represented as X (mm) and a hardness in JIS-C hardness of the intermediate layer 2 is represented as Y, it is required for the X and Y to have a correlation represented by the following formula:

$$10X+55 \leqq Y \leqq 10X+75.$$

When the Y is larger than (10X+75), the intermediate layer does not deform when hit at low head speed, and the shot feel is hard and poor when hit by a short iron club and the like. On the other hand, when the Y is smaller than (10X+55), the golf ball deforms in whole, but also deforms partially when hit at high head speed. Therefore the shot feel when hit by a driver and the like is heavy and poor.

In the golf ball of the present invention, it is required for the intermediate layer 2 to have the thickness (X) of 0.3 to 1.5 mm. When the thickness is smaller than 0.3 mm, the golf ball does not partially deform when hit at low head speed, and the shot feel is hard and poor when hit by a short iron club and the like. On the other hand, when the thickness is larger than 1.5 mm, the golf ball deforms in whole, but also deforms partially when hit at high head speed. Therefore the shot feel when hit by a driver and the like is heavy and poor. The thickness of the intermediate layer 2 is preferably 0.4 to 1.2 mm, more preferably 0.4 to 0.9 mm.

It is desired for the intermediate layer 2 to have the hardness (Y) in JIS-C hardness of 58 to 80, preferably 60 to 75. When the hardness is smaller than 58, the rebound characteristics are largely degraded and the deformation amount is large, and the shot feel is heavy and poor and the flight distance is reduced. On the other hand, when the hardness is larger than 80, the deformation amount is small, and the shot feel is hard and poor when hit at low head speed by a short iron club and the like.

In the golf ball of the present invention, it is desired that the hardness (Y) of the intermediate layer 2 be lower than the surface hardness (B) of the core 1, preferably lower than the surface hardness (B) by 5 to 35, more preferably by 10 to 30. When the hardness (Y) of the intermediate layer 2 is not less than the surface hardness (B) of the core 1, the golf ball does not partially deform when hit at low head speed, and the spin amount at approach shot is small and the shot feel is poor. The term "a hardness in JIS-C hardness of the intermediate layer 2" as used herein means a JIS-C hardness measured using a sample of a stack of three slabs (heat and press molded sheets) having a thickness of about 2 mm from the intermediate layer composition, which is produced at the same vulcanization condition as the production of the golf ball.

In the golf ball of the present invention, the intermediate layer 2 is preferably formed by press-molding the rubber composition as used in the core 1, which essentially contains polybutadiene, a co-crosslinking agent, an organic peroxide and a filler. Since the intermediate layer 2, which is not formed from thermoplastic resin, such as ionomer resin, thermoplastic elastomer, diene copolymer and the like, is formed from the press-molded article of the rubber composition, the rebound characteristics are improved. When the intermediate layer is formed from thermoplastic resin, the intermediate layer can be prepared by injection molding. However, it is difficult to prepare the intermediate layer 2 of the present invention by injection molding, because the intermediate layer 2 has a thickness of 0.3 to 1.5 mm, which is very thin.

Since the core 1 and the intermediate layer 2 are formed from the same vulcanized rubber composition, the adhesion between the core 1 and the intermediate layer 2 is excellent, and the durability is improved. Rubber, when compared with resin, has a little deterioration of is performance at low temperature lower than room temperature as known in the art, and thus the intermediate layer of the present invention formed from the rubber has excellent rebound characteristics at low temperature.

The cover 3 is then covered on the intermediate layer 2. In the golf ball of the present invention, it is desired for the cover 3 to have a thickness of 1.0 to 2.5 mm, preferably 1.5 to 2.0 mm. When the thickness is smaller than 1.0 mm, the technical effects accomplished by the presence of the cover are not sufficiently obtained, and the spin amount is not sufficiently obtained at approach shot and the like. On the other hand, when the thickness is larger than 2.5 mm, the rebound characteristics are largely degraded, which reduces the flight distance. In addition, the shot feel is hard and poor.

In the golf ball of the present invention, it is desired that the hardness (Y) of the intermediate layer 2 be lower than the hardness (C) in JIS-C hardness of the cover 3, preferably lower than the hardness (C) by 5 to 35, more preferably by 10 to 30. When the hardness (Y) of the intermediate layer 2 is not less than the hardness (C) of the cover 3, the golf ball does not partially deform when hit at low head speed with effect, and the spin amount at approach shot is small and the shot feel is hard and poor.

In the golf ball of the present invention, it is required for the cover 3 to have a hardness in JIS-C of 70 to 93, preferably 75 to 91, more preferably 80 to 89. When the hardness is smaller than 70, the rebound characteristics are largely degraded and the spin amount when hit by a driver is high, which reduces the flight distance. On the other hand, when the hardness is larger than 93, the sufficient spin amount to obtain the desired controllability is obtained, or the impact force when hit particularly at low head speed is large. The term "hardness of the cover" as used herein refers to the surface hardness in JIS-C hardness of the golf ball, which is obtained by covering the two-layer structured core formed as described above with the cover.

The cover 3 of the present invention contains thermoplastic resin, particularly ionomer resin, which has been conventionally used for the cover of golf balls, as a base resin. The ionomer resin may be a copolymer of ethylene and α, β-unsaturated carboxylic acid, of which a portion of carboxylic-acid groups is neutralized with metal ion, or a terpolymer of ethylene, α, β-unsaturated carboxylic acid and α, β-unsaturated carboxylic acid ester, of which a portion of carboxylic acid groups is neutralized with metal ion. Examples of the α, β-unsaturated carboxylic acid in the ionomer include acrylic acid, methacrylic acid, fumaric acid, maleic acid, crotonic acid and the like, preferred are acrylic acid and methacrylic acid. Examples of the α, β-unsaturated carboxylic acid ester in the ionomer include methyl ester, ethyl ester, propyl ester, n-butyl ester and isobutyl ester of acrylic acid, methacrylic acid, fumaric acid, maleic acid and the like. Preferred are acrylic acid esters and methacrylic acid esters. The metal ion which neutralizes a portion of carboxylic acid groups of the copolymer or terpolymer includes a sodium ion, a potassium ion, a lithium ion, a magnesium ion, a calcium ion, a zinc ion, a barium ion, an aluminum, a tin ion, a zirconium ion, cadmium ion, and the like. Preferred are sodium ions, zinc ions, magnesium ions and the like, in view of rebound characteristics, durability and the like.

The ionomer resin is not limited, but examples thereof will be shown by a trade name thereof. Examples of the ionomer resins, which are commercially available from Mitsui Du Pont Polychemical Co., Ltd. include Hi-milan 1555, Hi-milan 1557, Hi-milan 1605, Hi-milan 1652, Hi-milan 1702, Hi-milan 1705, Hi-milan 1706, Hi-milan 1707, Hi-milan 1855, Hi-milan 1856 and the like. Examples of the ionomer resins, which are commercially available from Du Pont Co., include Surlyn 8945, Surlyn 9945, Surlyn 6320, Surlyn AD8511, Surlyn AD8512, Surlyn AD8542 and the like. Examples of the ionomer resins, which are commercially available from Exxon Chemical Co., include Iotek 7010, Iotek 8000 and the like. These ionomer resins may be used alone or in combination.

As the materials suitably used in the cover 3 of the present invention, the above ionomer resin may be used alone, but the ionomer resin may be used in combination with at least one of thermoplastic elastomer, diene block copolymer and the like.

Examples of the thermoplastic elastomers include polyamide-based thermoplastic elastomer, which is commercially available from Toray Co., Ltd. under the trade name of "Pebax" (such as "Pebax 2533"); polyester-based thermoplastic elastomer, which is commercially available from Toray-Du Pont Co., Ltd. under the trade name of "Hytrel" (such as "Hytrel 3548", "Hytrel 4047"); polyurethane-based thermoplastic elastomer, which is commercially available from Takeda Badische Urethane Industries, Ltd. under the trade name of "Elastollan" (such as "Elastollan ET880"); and the like.

The diene block copolymer is a block copolymer or partially hydrogenated block copolymer having double bond derived from conjugated diene compound. The base bock copolymer is block copolymer composed of block polymer block A mainly comprising at least one aromatic vinyl compound and polymer block B mainly comprising at least one conjugated diene compound. The partially hydrogenated block copolymer is obtained by hydrogenating the block copolymer. Examples of the aromatic vinyl compounds comprising the block copolymer include styrene, α-methyl styrene, vinyl toluene, p-t-butyl styrene, 1,1-diphenyl styrene and the like, or mixtures thereof. Preferred is styrene. Examples of the conjugated diene compounds include butadiene, isoprene, 1,3-pentadiene, 2,3-dimethyl-1,3-butadiene and the like, or mixtures thereof. Preferred are butadiene, isoprene and combinations thereof. Examples of the diene block copolymers include an SBS (styrene-butadiene-styrene) block copolymer having polybutadiene block with epoxy groups or SIS (styrene-isoprene-styrene) block copolymer having polyisoprene block with epoxy groups and the like. Examples of the diene block copolymers, which are commercially available, include the diene block copolymers, which are commercially available from Daicel Chemical Industries, Ltd. under the trade name of "Epofriend" (such as "Epofriend A1010") and the like.

The amount of the thermoplastic elastomer or diene block copolymer is 1 to 60 parts by weight, preferably 1 to 35 parts by weight, based on 100 parts by weight of the base resin for the cover. When the amount is smaller than 1 parts by weight, the technical effects of absorbing the impact force at the time of hitting accomplishing by using them are not sufficiently obtained. On the other hand, when the amount is larger than 60 parts by weight, the cover is too soft and the rebound characteristics are degraded, or the compatibility with the ionomer resin is degraded and the durability is degraded.

The composition for the cover used in the present invention may optionally contain pigments (such as titanium dioxide, etc.) and the other additives such as a dispersant, an antioxidant, a UW absorber, a photostabilizer and a fluorescent agent or a fluorescent brightener, etc., in addition to the resin component, as long as the addition of the additives does not deteriorate the desired performance of the golf ball cover.

A method of covering with the cover 3 is not specifically limited, but may be a conventional method. For example, there can be used a method comprising molding the cover composition into a semi-spherical half-shell in advance, covering the core, which is covered with the intermediate layer, with the two half-shells, followed by pressure molding at 130 to 170° C. for 1 to 5 minutes, or a method comprising injection molding the cover composition directly on the core to cover it. At the time of molding the cover, many depressions called "dimples" may be optionally formed on the surface of the golf ball. Furthermore, paint finishing or marking with a stamp may be optionally provided after the cover molded for commercial purposes.

EXAMPLES

The following Examples and Comparative Examples further illustrate the present invention in detail but are not to be construed to limit the scope of the present invention.

Examples 1 to 5 and Comparative Examples 1 to 3 and 5

(i) Production of Unvulcanized Molded Article for the Core

The rubber compositions for the core shown in Table 1 (Examples) and Table 2 (Comparative Examples) were mixed, and then extruded to obtain cylindrical unvulcanized plugs.

(ii) Production of Vulcanized Semi-spherical Half-shell for the Intermediate Layer The rubber compositions for the outer core shown in Table 1 (Examples) and Table 2 (Comparative Examples) were mixed, and then vulcanized by press-molding at the vulcanization condition shown in the same Tables in the mold (4, 5) as described in FIG. 2 to obtain vulcanized semi-spherical half-shells 6 for the intermediate layer.

(iii) Production of Two-layer Structured Core

The cylindrical unvulcanized plugs 8 produced in the step (i) were covered with the two vulcanized semi-spherical half-shells 6 for the intermediate layer produced in the step (ii), and then vulcanized by press-molding at the vulcanization condition shown in the same Tables in the mold 7 as described in FIG. 3 to obtain two-layer structured cores. The resulting two-layer structured core was cut into two equal, and then a center hardness of the core and a thickness of the intermediate layer were measured in section. The results are shown in Table 5 (Examples) and Table 6 (Comparative Examples). A surface hardness and diameter of the core were measured, after removing the intermediate layer from the two-layer structured core to expose the core. The results are shown in the same Tables. A hardness in JIS-C hardness of the intermediate layer was measured, using a sample of a stack of three heat and press molded sheets having a thickness of about 2 mm from the intermediate layer composition, which is produced at the same vulcanization condition as the production of each golf ball. The results are shown in the same Tables. A difference (B-A) between the surface hardness and center hardness of the core, and a difference (B-Y) between the surface hardness of the core and the hardness of the intermediate layer were calculated from the hardness values described above. The results are shown in the same Tables.

Comparative Example 4

Production of Core

The rubber composition for the core shown in Table 2 (Comparative Examples) was mixed, and then vulcanized by press-molding at the vulcanization condition shown in the same Table in the mold to obtain a single-layer structured core. A diameter and hardness (center hardness (A) and surface hardness (B)) of the resulting core were measured, and the results are shown in Table 6 (Comparative Examples). A difference (B-A) between the surface hardness and center hardness of the core was calculated from the hardness values described above. The results are shown in the same Table.

TABLE 1

(parts by weight)

| | Example No. 1 | 2 | 3 | 4 | 5 | 6 |
|---|---|---|---|---|---|---|
| (Core composition) | | | | | | |
| BR-18 *1-1 | 100 | 100 | 100 | 100 | 100 | 100 |
| Zinc acrylate | 36.5 | 36.5 | 36.5 | 34 | 36.5 | 34 |
| Zinc oxide | 6 | 6 | 6 | 6 | 6 | 6 |
| Dicumyl peroxide | 0.6 | 0.6 | 0.6 | 0.6 | 0.6 | 0.6 |
| Diphenyl disulfide | 0.5 | 0.5 | 0.5 | 0.5 | 0.5 | 0.5 |
| Tungsten | 9.5 | 9.5 | 9.5 | 10.1 | 7.1 | 9.5 |
| (Intermediate layer composition) | | | | | | |
| BR-10 *1-2 | 20 | 20 | 20 | 20 | 20 | 20 |
| BR-11 *1-3 | 80 | 80 | 80 | 80 | 80 | 80 |
| Methacrylic acid | 22.2 | 22.2 | 22.2 | 22.2 | 22.2 | 22.2 |
| Magnesium oxide | 28.4 | 28.4 | 28.4 | 28.4 | 28.4 | 28.4 |
| Zinc acrylate | — | — | — | — | — | — |
| Zinc oxide | — | — | — | — | — | — |
| Dicumyl peroxide | 1.9 | 1.9 | 1.9 | 1.9 | 1.9 | 1.9 |
| Tungsten | 39.1 | 39.1 | 39.1 | 39.1 | 39.1 | 54.5 |

Vulcanization condition: Temperature (°C.) × Time (min)

| | | | | | | | | |
|---|---|---|---|---|---|---|---|---|
| Intermediate layer | | °C. | 150 | 150 | 150 | 150 | 150 | 150 |
| | | min | 5 | 5 | 5 | 5 | 5 | 5 |
| Core | The first stage | °C. | 165 | 165 | 165 | 165 | 165 | 150 |
| | | min | 19 | 19 | 20 | 19 | 19 | 25 |
| | The second stage | °C. | — | — | — | — | — | 165 |
| | | min | — | — | — | — | — | 8 |

TABLE 2

(parts by weight)

| | | Comparative Example No. 1 | 2 | 3 | 4 |
|---|---|---|---|---|---|
| (Core composition) | | | | | |
| BR-18 *1–1 | | 100 | 100 | 100 | 100 |
| Zinc acrylate | | 36.5 | 36.5 | 36.5 | 36 |
| Zinc oxide | | 6 | 6 | 6 | 12 |
| Dicumyl peroxide | | 0.6 | 0.6 | 0.6 | 0.6 |
| Diphenyl disulfide | | 0.5 | 0.5 | 0.5 | 0.5 |
| Tungsten | | 3.3 | 9.5 | 9.5 | 9.5 |
| (Intermediate layer composition) | | | | | |
| BR-10 *1–2 | | 20 | 20 | 20 | |
| BR-11 *1–3 | | 80 | 80 | 80 | |
| Methacrylic acid | | 22.2 | — | 22.2 | |
| Magnesium oxide | | 28.4 | — | 28.4 | |
| Zinc acrylate | | — | 35 | — | |
| Zinc oxide | | — | 15 | — | |
| Dicumyl peroxide | | 1.9 | 1.9 | 1.9 | |
| Tungsten | | 54.5 | 54.5 | 54.5 | |
| Vulcanization condition: Temp. (° C.) × Time (min) | | | | | |
| Intermediate layer | (° C.) | 150 | 143 | 150 | — |
| | (min) | 5 | 5 | 5 | |
| Core The first stage | (° C.) | 165 | 165 | 165 | 165 |
| | (min) | 19 | 19 | 19 | 19 |
| The second stage | (° C.) | — | — | — | — |
| | (min) | — | — | — | — |

*1-1: High-cis polybutadiene (trade name "BR-18") available from JSR Co., Ltd. (Content of 1,4-cis-polubutadiene: 96%
*1-2: High-cis polybutadiene (trade name "BR-10") available from JSR Co., Ltd. (Content of 1,4-cis-polubutadiene: 96%
*1-3: High-cis polybutadiene (trade name "BR-11") available from JSR Co., Ltd. (Content of 1,4-cis-polubutadiene: 96%

(iv) Preparation of Cover Compositions

The formulation materials showed in Table 3 (Examples) and Table 4 (Comparative Examples) were mixed using a kneading type twin-screw extruder to obtain pelletized cover compositions. The extrusion condition was, a screw diameter of 45 mm, a screw speed of 200 rpm, and a screw L/D of 35.

The formulation materials were heated at 150 to 260° C. at the die position of the extruder.

TABLE 3

(parts by weight)

| Cover composition | Example No. 1 | 2 | 3 | 4 | 5 | 6 |
|---|---|---|---|---|---|---|
| Hi-milan 1555 *2 | 10 | — | 10 | 10 | 10 | 10 |
| Hi-milan 1557 *3 | — | — | — | — | — | — |
| Hi-milan 1605 *4 | 5 | 5 | 5 | 5 | 5 | 5 |
| Hi-milan 1707 *5 | — | — | — | — | — | — |
| Hi-milan 1855 *6 | 55 | 85 | 55 | 55 | 55 | 55 |
| Surlyn 6320 *7 | 30 | 30 | 30 | 30 | 30 | 30 |
| Titanium dioxide | 3 | 3 | 3 | 3 | 3 | 3 |
| Barium sulfate | 1 | 1 | 1 | 1 | 1 | 1 |

TABLE 4

(parts by weight)

| Cover composition | Comparative Example No. 1 | 2 | 3 | 4 |
|---|---|---|---|---|
| Hi-milan 1555 *2 | 10 | 10 | — | 10 |
| Hi-milan 1557 *3 | — | — | 30 | — |
| Hi-milan 1605 *4 | 5 | 5 | — | 5 |
| Hi-milan 1707 *5 | — | — | 20 | — |
| Hi-milan 1855 *6 | 55 | 55 | 50 | 55 |
| Surlyn 6320 *7 | 30 | 30 | — | 30 |
| Titanium dioxide | 3 | 3 | 3 | 3 |
| Barium sulfate | 1 | 1 | 1 | 1 |

*2: Hi-milan 1555 (trade name), ethylene-methacrylic acid copolymer ionomer resin obtained by neutralizing with sodium ion, manufactured by Mitsui Du Pont Polychemical Co., Ltd.
*3: Hi-milan 1557 (trade name), ethylene-methacrylic acid copolymer ionomer resin obtained by neutralizing with zinc ion, manufactured by Mitsui Du Pont Polychemical Co., Ltd.
*4: Hi-milan 1605 (trade name), ethylene-methacrylic acid copolymer ionomer resin obtained by neutralizing with sodium ion, manufactured by Mitsui Du Pont Polychemical Co., Ltd.
*5: Hi-milan 1707 (trade name), ethylene-methacrylic acid copolymer ionomer resin obtained by neutralizing with sodium ion, manufactured by Mitsui Du Pont Polychemical Co., Ltd.
*6: Hi-milan 1855 (trade name), ethylene-methacrylic acid-isobutyl acrylate terpolymer ionomer resin obtained by neutralizing with zinc ion, manufactured by Mitsui Du Pont Polychemical Co., Ltd.
*7: Surlyn 6320 (trade name), ethylene-methacrylic acid-n-butyl acrylate terpolymer ionomer resin obtained by neutralizing with magnesium ion, manufactured by DuPont Co.

Examples 1 to 6 and Comparative Examples 1 to 4

The compositions for the cover were covered on the two-layer structured core and single-layer structured core by injection molding to form the cover layer 3 having a thickness and JIS-C hardness (C) shown in Table 5 (Examples) and Table 6 (Comparative Examples). Then, paint was applied on the surface to produce golf ball having a diameter of 42.7 mm. With respect to the resulting golf balls, the initial velocity, spin amount (backspin), flight distance, impact force and shot feel were measured or evaluated. The results are shown in Table 7 (Examples and Comparative Examples) and Table 8 (Examples and Comparative Examples). The test methods are as follows.

Test Method

[1] Hardness (1) Hardness of the Core

A center hardness of the core (A) is determined by cutting the two-layer structured core, which is formed by integrally press-molding the core and the intermediate layer, into two equal, and then measuring a JIS-C hardness at the center point of the core in section. A surface hardness of the core (B) is determined by removing the intermediate layer from the two-layer structured core to expose the core after molding, and measuring a JIS-C hardness at the surface of the exposed core.

(2) Hardness of the Intermediate Layer

A hardness of the intermediate layer (Y) was determined by measuring a slab hardness in JIS-C hardness, using a sample of a stack of three heat and press molded sheets having a thickness of about 2 mm from the intermediate layer composition, which is produced at the same vulcanization condition as the production of each golf ball.

(3) Hardness of Cover

A hardness of the cover (C) was determined by measuring a JIS-C hardness at the surface of the golf ball, which is obtained by covering the intermediate layer and then the cover layer.

In the (1) to (3), the JIS-C hardness was measured with a JIS-C hardness meter according to JIS K 6301.

[2] Flight Performance (i) Flight Performance 1

After a No. 1 wood club (a driver, W#1; "Newbreed Tour Forged" loft angle=8.5 degrees, V-12G Carbon X shaft, manufactured by Sumitomo Rubber Industries, Ltd.) was mounted to a swing robot manufactured by Swing Laboratory Co. and a golf ball was hit at an incidence angle of upper 1° and head speed of 49 m/sec, the initial velocity, spin amount (backspin) and flight distance were measured. As the flight distance, total that is a distance to the stop point of the hit golf ball was measured. As the spin amount, backspin amount immediately after hitting (W) was measured by continuously taking a photograph of a mark provided on the hit golf ball using a high-speed camera. The measurement was conducted 12 times for each golf ball (n=12), and the average is shown as the result of the golf ball.

(ii) Flight Performance 2

After a sand wedge (SW; "Newbreed Pro Model " V-10 Carbon S shaft, manufactured by Sumitomo Rubber Industries, Ltd.) was mounted to a swing robot manufactured by Swing Laboratory Co. and a golf ball was hit at an incidence angle of down 8° and head speed of 21 m/sec, the initial velocity and spin amount (backspin) were measured. As the spin amount, backspin amount immediately after hitting (S) was measured by continuously taking a photograph of a mark provided on the hit golf ball using a high-speed camera. The measurement was conducted 12 times for each golf ball (n=12), and the average is shown as the result of the golf ball. A ratio (W/S) of the spin amount W to the spin amount S was calculated from the results described above.

(3) Impact Force

Figure 4:
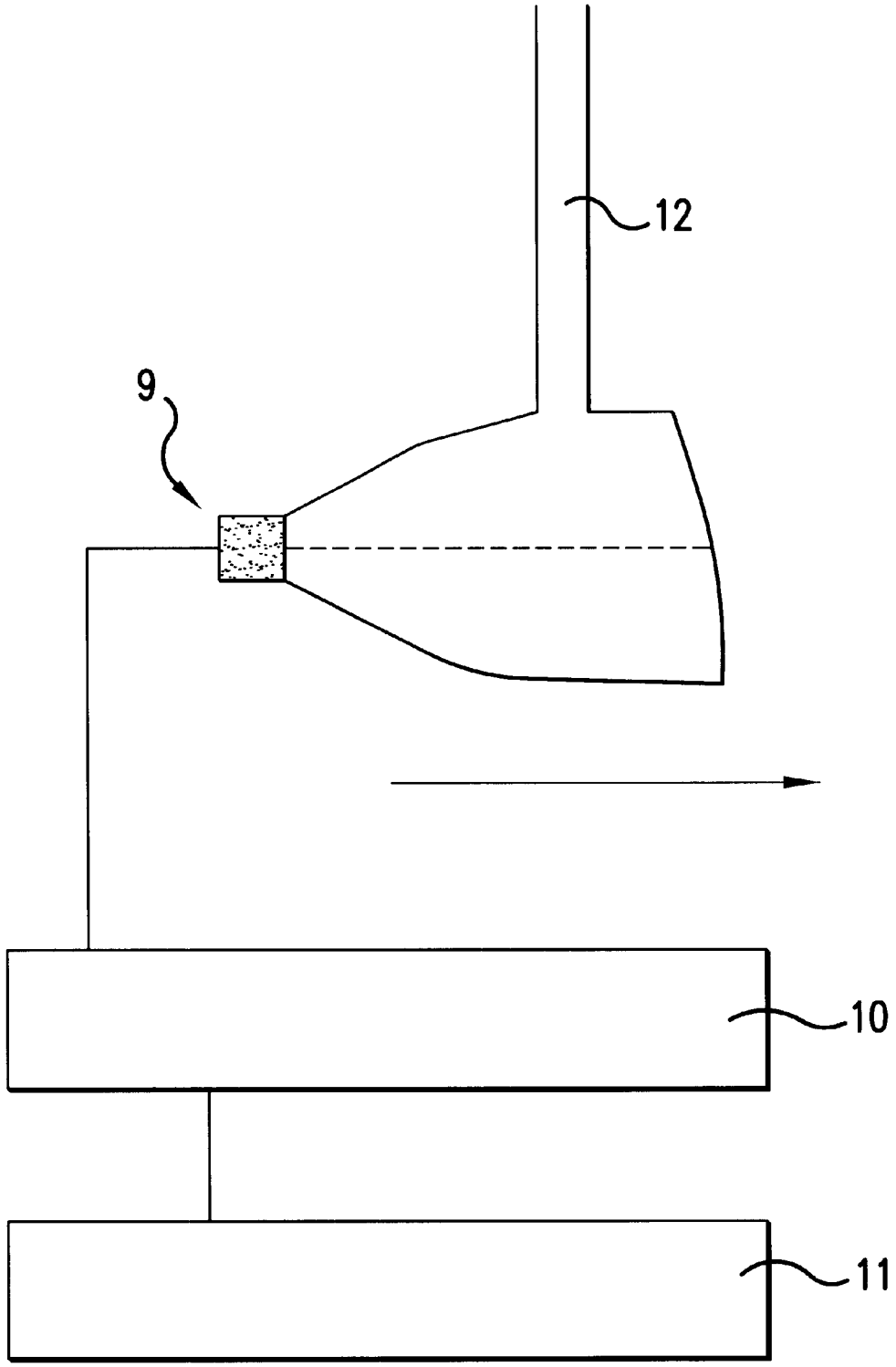
FIG. 4 is a schematic illustrating a method of measuring impact force when hit by a driver.
Figure 5:
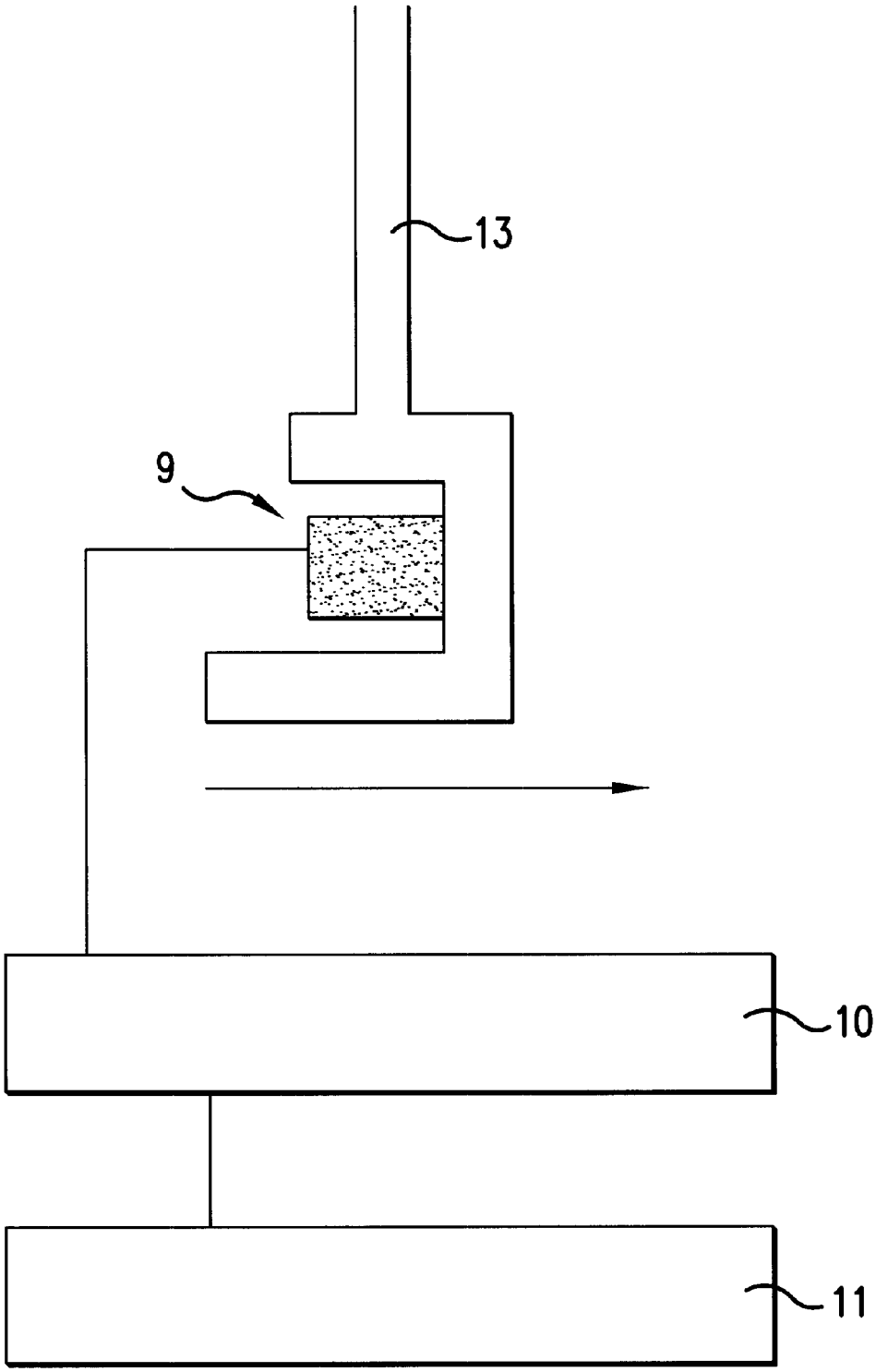
FIG. 5 is a schematic illustrating a method of measuring impact force when hit by a putter.
Figure 6:
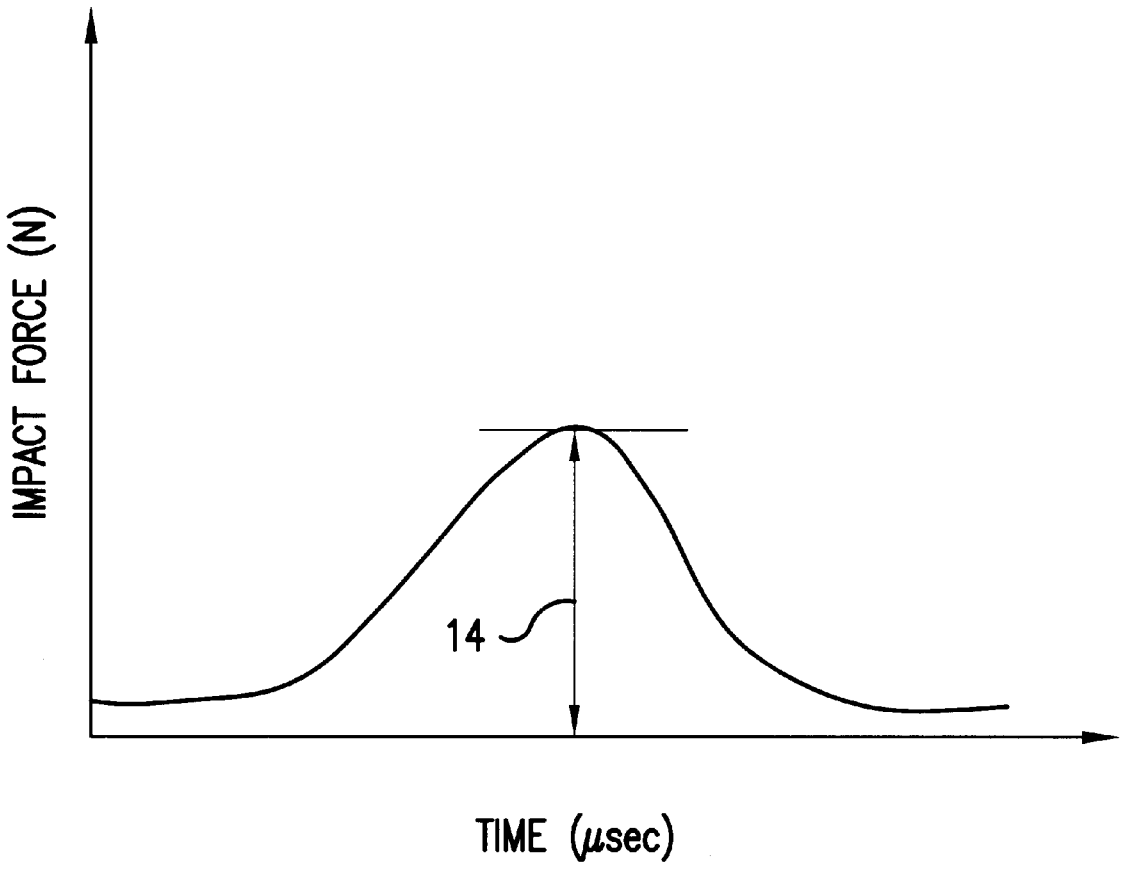
FIG. 6 is a graph illustrating the correlation of impact force with time.

The acceleration in the opposite direction of moving the golf club on impact was measured by an acceleration pickup. The impact force was determined by changing the acceleration into force as represented by the following formula:

$$F=m\times a$$

wherein "F" represents a force, "m" represents the weight of club head and "a" represents an acceleration at the time of hitting. The acceleration pickup used is "Acceler type 4374 (trade name)", manufactured by Brueel & Kjaer Co., and attached to the side sole portion of the golf club head on an opposite side of a striking point with the ball in parallel perpendicular to an axis of a shaft of the golf club, which are a driver ("DP-901" loft angle=11 degrees, shaft: "Dynamic Gold X400", manufactured by Sumitomo Rubber Industries, Ltd., which is remade for the measurement of impact force) and a putter ("MAXFLI TM-8", manufactured by Sumitomo Rubber Industries, Ltd., which is remade for the measurement of impact force). As shown in FIG. 4 and FIG. 5, after the acceleration pickup 9 was attached to the driver 12 and putter 13 and the golf ball was hit, a graph illustrating the correlation of impact force with time shown in FIG. 6 was obtained in a digital oscilloscope 11 by reading the acceleration using a charge amplifier 10. The impact force at the peak of the resulting curve is the maximum impact force 14. The charge amplifier used is "charge amplifier type 2635", manufactured by Brueel & Kjaer Co., and the oscilloscope used is "DS6612", manufactured by Iwatsu Co., Ltd.

(i) In case of using a driver, after the driver was mounted to a swing robot manufactured by Swing Laboratory Co. and each golf ball was hit at a head speed of 49 m/second, the maximum impact force D at the time of hitting was measured.

(ii) In case of using a putter, after a grip of the putter was mounted to a three-legged support and each golf ball was hit at a head speed of 2.9 m/second by swinging the putter down from the position at the angle of 40 degrees of a vertical line like a pendulum, the maximum impact force P at the time of hitting was measured. The ratio of impact force (P/D) was determined by calculating from the results of the impact force described above.

(4) Shot Feel

The shot feel of the golf ball is evaluated by 10 golfers according to a practical hitting test using a No. 1 wood club (W#1, a driver), a No. 5 iron club (I#5), approach (a No. 7 iron club (I#7) and a sand wedge (SW)) and a putter. The evaluation criteria are as follows. The results shown in the Tables below are based on the fact that the most golfers evaluated with the same criterion about shot feel.

Evaluation Criteria

○○: Very good

○: Good

Δ: Fairly good x1: Heavy and poor x2: Hard and poor

Test Result

TABLE 5

| Test item | | Example No. 1 | 2 | 3 | 4 | 5 | 6 |
|---|---|---|---|---|---|---|---|
| (Core) | | | | | | | |
| Diameter (mm) | | 37.95 | 37.95 | 37.95 | 37.95 | 36.95 | 37.95 |
| Hardness (JIS-C) | Center hardness (A) | 60 | 60 | 66 | 58 | 60 | 71 |
| | Surface hardness (B) | 86 | 86 | 86 | 84 | 86 | 83 |
| | Difference (B-A) | 26 | 26 | 20 | 26 | 26 | 12 |
| (Intermediate layer) | | | | | | | |
| Thickness × (mm) | | 0.5 | 0.5 | 0.5 | 0.5 | 1.0 | 0.5 |
| 10× + 55 | | 60 | 60 | 60 | 60 | 65 | 60 |
| 10× + 75 | | 80 | 80 | 80 | 80 | 85 | 80 |
| JIS-C hardness (Y) | | 65 | 65 | 65 | 65 | 65 | 65 |

TABLE 5-continued

| Test item | Example No. 1 | 2 | 3 | 4 | 5 | 6 |
|---|---|---|---|---|---|---|
| Difference (B-Y) | 21 | 21 | 21 | 19 | 21 | 18 |
| (Cover) | | | | | | |
| Thickness (mm) | 1.9 | 1.9 | 1.9 | 1.9 | 1.9 | 1.9 |
| JIS-C hardness (C) | 87 | 89 | 87 | 87 | 87 | 87 |
| Difference (C-Y) | 22 | 24 | 22 | 22 | 22 | 22 |

TABLE 6

| Test item | | Comparative Example No. 1 | 2 | 3 | 4 |
|---|---|---|---|---|---|
| (Core) | | | | | |
| Diameter (mm) | | 35.55 | 37.95 | 37.95 | 38.95 |
| Hardness (JIS-C) | Center hardness (A) | 60 | 60 | 60 | 60 |
| | Surface hardness (B) | 86 | 86 | 86 | 86 |
| | Difference (B-A) | 26 | 26 | 26 | 26 |
| (Intermediate layer) | | | | | |
| Thickness X (mm) | | 1.7 | 0.5 | 0.5 | — |
| 10X + 55 | | 72 | 60 | 60 | |
| 10X + 75 | | 92 | 80 | 80 | |
| JIS-C hardness (Y) | | 65 | 88 | 65 | |
| Difference (B-Y) | | 21 | −2 | 21 | |
| (Cover) | | | | | |
| Thickness (mm) | | 1.9 | 1.9 | 1.9 | 1.9 |
| JIS-C hardness (C) | | 87 | 87 | 96 | 87 |
| Difference (C-Y) | | 22 | −1 | 30 | — |

TABLE 7

| Test item | | Example No. 1 | 2 | 3 | 4 | 5 |
|---|---|---|---|---|---|---|
| Flight performance 1 (W#1, 49 m/sec) | | | | | | |
| Initial velocity (m/sec) | | 71.3 | 71.5 | 71.4 | 71.0 | 71.1 |
| Back spin amount W (rpm) | | 2670 | 2660 | 2800 | 2500 | 2700 |
| Carry (m) | | 232.8 | 233.2 | 231.9 | 232.3 | 232.1 |
| Flight performance 2 (SW, 21 m/sec) | | | | | | |
| Initial velocity (m/sec) | | 19.6 | 19.6 | 19.6 | 19.6 | 19.6 |
| Back spin amount S (rpm) | | 6440 | 6320 | 6500 | 6340 | 6500 |
| Ratio of (W/S) | | 0.41 | 0.42 | 0.43 | 0.39 | 0.42 |
| Maximum impact force | | | | | | |
| W#1 | D (N) | 16200 | 16270 | 16670 | 15120 | 16140 |
| Putter | P (N) | 456 | 464 | 459 | 437 | 448 |
| Ratio of (P/D) | | 0.028 | 0.029 | 0.028 | 0.029 | 0.028 |
| Shot feel | W#1 | ○○ | ○○ | ○ | ○ | ○ |
| | I#5 | ○○ | ○○ | ○○ | ○○ | ○ |
| | Approach | ○○ | ○○ | ○○ | ○○ | ○○ |
| | Putter | ○○ | ○ | ○○ | ○○ | ○○ |

TABLE 8

| Test item | | Ex. 6 | Comparative Example No. 1 | 2 | 3 | 4 |
|---|---|---|---|---|---|---|
| Flight performance 1 (W#1, 49 m/sec) | | | | | | |
| Initial velocity (m/sec) | | 71.7 | 70.9 | 71.5 | 71.8 | 71.4 |
| Back spin amount W (rpm) | | 2990 | 2950 | 2650 | 2620 | 2750 |
| Carry (m) | | 232.0 | 229.5 | 233.2 | 233.4 | 231.5 |
| Flight performance 2 (SW, 21 m/sec) | | | | | | |
| Initial velocity (m/sec) | | 19.7 | 19.4 | 19.8 | 19.5 | 19.7 |
| Back spin amount S (rpm) | | 6590 | 6510 | 5800 | 5550 | 6000 |
| Ratio of (W/S) | | 0.45 | 0.45 | 0.46 | 0.47 | 0.46 |
| Maximum impact force | | | | | | |
| W#1 | D (N) | 16620 | 15720 | 16430 | 17410 | 16380 |
| Putter | P (N) | 492 | 427 | 506 | 536 | 501 |
| Ratio of (P/D) | | 0.030 | 0.027 | 0.031 | 0.031 | 0.031 |
| Shot feel | W#1 | Δ | x1 | ○○ | ○ | ○ |
| | I#5 | ○ | x1 | Δ | x2 | Δ |
| | Approach | ○ | ○ | x2 | x2 | x2 |
| | Putter | ○○ | ○○ | x2 | x2 | x2 |

As is apparent from Tables 5 to 8, the multi-piece solid golf balls of the present invention of Examples 1 to 6, which are obtained by adjusting a thickness and hardness of the intermediate layer and a hardness of the cover to specified ranges, had excellent flight performance and good shot feel, which is light and has good rebound, when hit by using a driver; had excellent controllability by accomplishing high spin amount when hit by a sand wedge; and had very soft and good shot feel at short iron shot to approach shot and put as compared with the conventional golf balls of Comparative Examples 1 to 4.

Among the golf balls of Examples having excellent performance as compared with the golf balls of Comparative Examples 1 to 4, the golf ball of Example 6 has smaller hardness difference (B-A) than the golf balls of the other Examples. Therefore it has slightly larger spin amount, which slightly reduces the flight distance, and it has slightly harder shot feel than the golf balls of the other Examples.

On the other hand, in the golf ball of Comparative Example 1, the thickness of the intermediate layer (X) is large and the hardness (Y) is smaller than the value of (10X+55), and the golf ball deforms in whole, but also deforms partially when hit at high head speed. Therefore the shot feel when hit by a driver and No. 5 iron club is heavy and poor.

In the golf ball of Comparative Example 2, the hardness of the intermediate layer (Y) is larger than the value of (10X+75), and the golf ball does not sufficiently deforms when hit at low head speed. Therefore the shot feel at approach shot or when hit by a putter is hard and poor.

In the golf ball of Comparative Example 3, the cover hardness is high, and the spin amount when hit by a sand wedge is low and the shot feel when hit by the golf club other than a driver is hard and poor.

The golf ball of Comparative Example 4, which is two-piece golf ball comprising a core and cover, does not have an intermediate layer, and the technical effects accomplished by the presence of the intermediate layer is not obtained. Therefore when hit at low head speed, particularly at approach shot or when hit by a putter, the shot feel is hard and poor.

It is preferable for the ratio of spin amount (W/S) to be smaller. When the ratio is small, the spin amount when hit by a driver is low and the spin amount at approach shot is high. Therefore in the golf balls of Examples 1 to 6 (W/S= not more than 0.45), particularly those of Examples 1 to 5 (W/S=not more than 0.43), the spin amount is low when hit by a driver, where the flight distance is regarded as most important, and the flight distance is long. In addition, the spin amount is high at approach shot, where the controllability is regarded as most important, and the controllability is good.

It is preferable for the ratio of impact force (P/D) to be smaller. If the ratio is small, the shot feel is responsive and good when hit by a driver, where responsive shot feel is required; and the shot feel is soft and good when hit by a shot iron club, where soft shot feel is required. Therefore in the golf balls of Examples 1 to 6, particularly Examples 1 to 5 (P/D=less than 0.03), the ratio is small, and the shot feel is totally good when hit by all golf clubs of a driver, long iron club, short iron club and putter.

What is claimed is:

1. A multi-piece solid golf ball comprising a core having at least one layer, an intermediate layer formed on the core, and a cover covering the intermediate layer, wherein assuming that a thickness of the intermediate layer is represented as X (mm) and a hardness in JIS-C hardness of the intermediate layer is represented as Y, X is within a range of 0.3 to 1.5 mm, X and Y have a correlation represented by the following formula:

$$10X+55 \leqq Y \leqq 10X+75,$$

and a hardness in JIS-C hardness of the cover is within a range of 70 to 93, and the hardness of the intermediate layer is lower than a surface hardness of the core, and is lower than the hardness of the cover.

2. The multi-piece solid golf ball according to claim 1, wherein a difference between a surface hardness of the core and a center hardness in JIS-C hardness of the core is within a range of 15 to 40.

3. The multi-piece solid golf ball according to claim 1, wherein the core has a diameter of from 34.5 to 40.5 mm.

4. The multi-piece solid golf ball according to claim 1, wherein the core has a center hardness of from 50 to 70 JIS-C.

5. The multi-piece solid golf ball according to claim 1, wherein the core has a surface hardness of from 70 to 95 JIS-C.

6. The multi-piece solid golf ball according to claim 1, wherein X is 0.4 to 1.2 mm.

7. The multi-piece solid golf ball according to claim 1, wherein X is 0.4 to 0.9 mm.

8. The multi-piece solid golf ball according to claim 1, wherein the cover has a thickness of 1.0 to 2.5 mm.

9. The multi-piece solid golf ball according to claim 1, wherein the cover has a surface hardness of 70 to 93.

10. A multi-piece solid golf ball comprising a core having at least one layer, an intermediate layer formed on the core, and a cover covering the intermediate layer, wherein assuming that a thickness of the intermediate layer is represented as X (mm) and a hardness in JIS-C hardness of the intermediate layer is represented as Y, X is within a range of 0.3 to 1.5 mm, X and Y have a correlation represented by the following formula:

$$10X+55 \leqq Y \leqq 10X+75,$$

and a hardness in JIS-C hardness of the cover is within a range of 70 to 93, wherein the core and the intermediate layer are formed from a vulcanized rubber composition.

11. The multi-piece solid golf ball according to claim 10, wherein Y is 58 to 80 JIS-C, and a difference between a surface hardness of the core and a center hardness in JIS-C hardness of the core is within a range of 15 to 40.

12. The multi-piece solid golf ball according to claim 10, wherein the vulcanized rubber composition comprises polybutadiene, a co-crosslinking agent, an organic peroxide and a filler, and the cover has a surface hardness of 70 to 93.

* * * * *